US008015928B2

(12) United States Patent
Chen

(10) Patent No.: US 8,015,928 B2
(45) Date of Patent: Sep. 13, 2011

(54) FOLDABLE TABLE HAVING MULTIPLE FUNCTIONS

(76) Inventor: Hsing-Hui Chen, Kaohsiung (TW)

( * ) Notice: Subject to any disclaimer, the term of this patent is extended or adjusted under 35 U.S.C. 154(b) by 401 days.

(21) Appl. No.: 12/335,694

(22) Filed: Dec. 16, 2008

(65) Prior Publication Data

US 2010/0147197 A1 Jun. 17, 2010

(51) Int. Cl.
*A47B 3/00* (2006.01)

(52) U.S. Cl. ..... 108/35; 108/115; 108/11; 190/12 A

(58) Field of Classification Search ..... 108/35, 108/41, 33, 26, 38, 11, 14, 16, 128; 312/311, 312/321, 249.2, 249.1, 262, 265, 258; 190/1, 190/11, 12 R, 12 A, 7, 6, 18 A
See application file for complete search history.

(56) References Cited

U.S. PATENT DOCUMENTS 2,614,018 A * 10/1952 Engel ..... 108/33
3,070,416 A * 12/1962 Post ..... 108/14
3,208,807 A * 9/1965 Becker ..... 190/12 R
4,427,391 A * 1/1984 Berman ..... 108/26
6,048,044 A * 4/2000 Biggel et al. ..... 312/258
6,474,677 B2 * 11/2002 Kasuya ..... 108/115
6,591,831 B2 * 7/2003 Reynolds ..... 108/26
6,698,364 B2 * 3/2004 Welch et al. ..... 108/115
6,817,302 B2 * 11/2004 Norstad ..... 108/115
6,840,182 B2 * 1/2005 Price ..... 108/118
6,997,115 B2 * 2/2006 Lockwood et al. ..... 108/115
7,849,859 B2 * 12/2010 Bochner et al. ..... 312/249.1

* cited by examiner

*Primary Examiner* — Jose V Chen
(74) *Attorney, Agent, or Firm* — Alan Kamrath; Kamrath & Associates PA

(57) ABSTRACT

A foldable table includes a stand, a rack, multiple placement boxes, a platform, and a wine storage rack. The stand is foldable. The foldable table can function as a bar table, desk, counter, sink, water tank, cabinet, shelf, wine compartment, by provision of the rack, the placement boxes, the platform and the wine storage rack. The foldable table can be folded when not in use, thereby facilitating packaging, transportation and storage of the foldable table. The foldable table is expanded and folded easily and quickly. The foldable table is folded to have a smaller volume and to have the shape of a luggage, thereby facilitating the user carrying the foldable table.

15 Claims, 6 Drawing Sheets

FOLDABLE TABLE HAVING MULTIPLE FUNCTIONS

BACKGROUND OF THE INVENTION

1. Field of the Invention

The present invention relates to a table and, more particularly, to a foldable bar table.

2. Description of the Related Art

A bar table is mounted in a bar to provide drinks, such as wines, juices and like, to the people inside of the bar. However, the conventional bar table has a fixed structure and occupies a larger space so that the conventional bar table cannot be folded and carried easily, thereby causing inconvenience to the user in packaging, transportation and storage of the conventional bar table. In addition, the conventional bar table cannot be used outdoors, thereby greatly decreasing the versatility of the conventional bar table.

BRIEF SUMMARY OF THE INVENTION

In accordance with the present invention, there is provided a table, comprising a stand including two casings pivotally connected with each other and two opposite support frames detachably connected with each other and each pivotally mounted on a respective one of the two casings.

The primary objective of the present invention is to provide a foldable table having multiple functions to function as a bar table, desk, counter, sink, water tank, cabinet, shelf, wine compartment and the like.

Another objective of the present invention is to provide a foldable table which can be folded to have the shape of a luggage.

A further objective of the present invention is to provide a foldable table that can function as a bar table, desk, counter, sink, water tank, cabinet, shelf, wine compartment and the like, by provision of the rack, the placement boxes, the platform and the wine storage rack, so that the foldable table has multiple functions, thereby greatly enhancing the versatility of the foldable table.

A further objective of the present invention is to provide a foldable table that can be folded when not in use, thereby facilitating packaging, transportation and storage of the foldable table.

A further objective of the present invention is to provide a foldable table that is expanded and folded easily and quickly, thereby facilitating a user operating the foldable table.

A further objective of the present invention is to provide a foldable table that is folded to have a smaller volume and to have the shape of a luggage, thereby facilitating the user carrying the foldable table.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
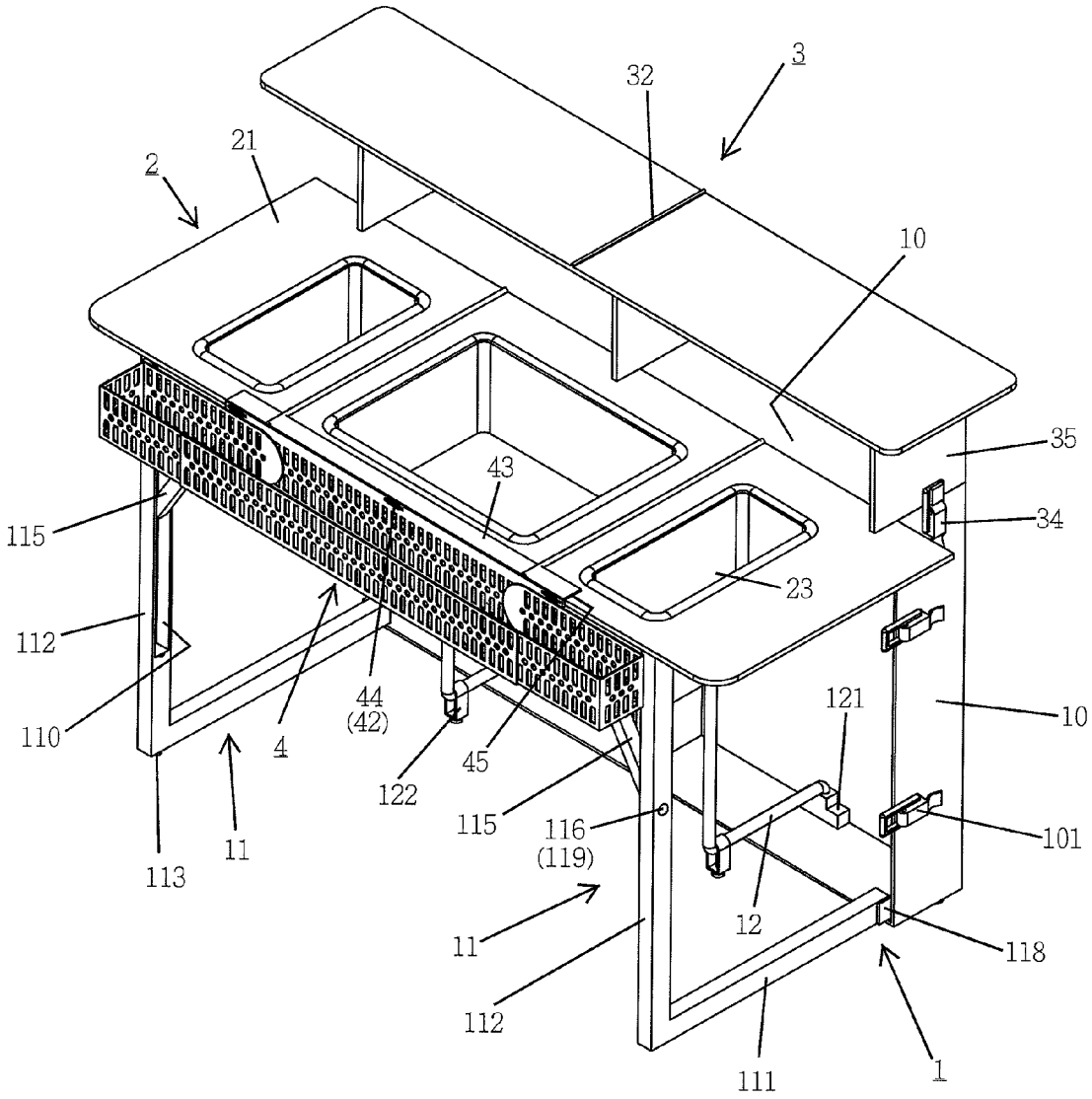
FIG. 1 is a perspective view of a foldable table in accordance with the preferred embodiment of the present invention.

Referring to the drawings and initially to FIGS. 1-5, a foldable table in accordance with the preferred embodiment of the present invention comprises a stand 1 including two casings 10 pivotally connected with each other, two opposite support frames 11 detachably connected with each other and each pivotally mounted on a respective one of the two casings 10, two opposite reinforcing frames 12 each pivotally mounted on a respective one of the two casings 10, a handle 103 retractably mounted on one of the two casings 10, and a castor 102 rotatably mounted on at least one of the two casings 10.

Each of the two casings 10 of the stand 1 has a side provided with a snap fastener 101 to fasten the two casings 10 when the two casings 10 are folded and juxtaposed to each other.

Each of the two support frames 11 of the stand 1 is foldable and includes two transverse bars 111 each having a first end pivotally mounted on the respective casing 10 by a hinge 118, an upright post 112 mounted between second ends of the two transverse bars 111 to connect the two transverse bars 111, a crossbar 114 pivotally connected with the upright post 112, an oblique strut 115 mounted between the upright post 112 and the crossbar 114, and an adjustable foot pad 113 mounted on a lower end of the upright post 112.

The upright post 112 of each of the two support frames 11 has a side provided with a locking hole 119. The upright post 112 of each of the two support frames 11 has an inner portion provided with an elongate guide track 110 to receive the crossbar 114 and the oblique strut 115 when the crossbar 114 and the oblique strut 115 are folded. The upright post 112 and the two transverse bars 111 of each of the two support frames 11 form a substantially U-shaped profile.

The crossbar 114 of each of the two support frames 11 has a first end pivotally mounted on an upper end of the upright post 112, and second ends of the crossbars 114 of the two support frames 11 are detachably connected with each other by a fastening member 117.

The oblique strut 115 of each of the two support frames 11 has a first end pivotally mounted on the crossbar 114 and a second end detachably locked onto the upright post 112. The second end of the oblique strut 115 of each of the two support frames 11 is provided with a protruding locking boss 116 detachably locked in the locking hole 119 of the upright post 112 to releasably lock the oblique strut 115 onto the upright post 112. The locking boss 116 the oblique strut 115 of each of the two support frames 11 is locked in the locking hole 119 of the upright post 112 when the crossbar 114 is disposed at a horizontal state.

Each of the two reinforcing frames 12 of the stand 1 has a substantially U-shaped profile. Each of the two reinforcing frames 12 has an upper end 120 pivotally mounted in the respective casing 10 and a lower end pivotally mounted in the respective casing 10 by a pivot seat 121. The lower end of each of the two reinforcing frames 12 is provided with a support foot 122 spaced from the pivot seat 121.

The foldable table further comprises a rack 2 mounted on the stand 1 and supported by the two support frames 11 and the two reinforcing frames 12 of the stand 1. The rack 2 is foldable and includes a plurality of flat plates 21 pivotally connected with each other and arranged in a serial manner. Each of the flat plates 21 of the rack 2 has a surface provided with a receiving slot 22 to receive a placement box 23.

The foldable table further comprises a platform 3 mounted on the stand 1 and supported by the two casings 10 of the stand 1. The platform 3 is detachably locked onto the two casings 10 of the stand 1 by two snap latches 34. The platform 3 is foldable and includes a plurality of elongate boards 31 pivotally connected with each other and arranged in a serial manner, and a plurality of upright legs 35 mounted on the elongate boards 31. The elongate boards 31 of the platform 3 are pivotally connected with each other by a plurality of hinges 32.

The foldable table further comprises a wine storage rack 4 detachably mounted on the rack 2. The wine storage rack 4 is foldable and includes a mounting bracket 43 detachably mounted on the flat plates 21 of the rack 2, and a plurality of receiving baskets 41 detachably mounted on the mounting bracket 43. The mounting bracket 43 of the wine storage rack 4 has an inner portion provided with a locking slot 45 detachably locked onto the flat plates 21 of the rack 2. The mounting bracket 43 of the wine storage rack 4 has a side provided with a plurality of hanging hooks 44. The receiving baskets 41 of the wine storage rack 4 are pivotally connected with each other and arranged in a serial manner. The receiving baskets 41 of the wine storage rack 4 are provided with a plurality of hanging holes 42 detachably hooked onto the hanging hooks 44 of the mounting bracket 43.

As shown in FIG. 1, the stand 1 is expanded outwardly, the rack 2 is mounted on the stand 1 and supported by the two support frames 11 and the two reinforcing frames 12 of the stand 1, the platform 3 is mounted on the stand 1 and supported by the two casings 10 of the stand 1, and the wine storage rack 4 is detachably mounted on the rack 2 to fully expand the foldable table. Thus, the foldable table can function as a bar table, desk, counter, sink, water tank, cabinet, shelf, wine compartment and the like, by provision of the rack 2, the placement boxes 23, the platform 3 and the wine storage rack 4, so that the foldable table has multiple functions, thereby greatly enhancing the versatility of the foldable table.

Figure 2:
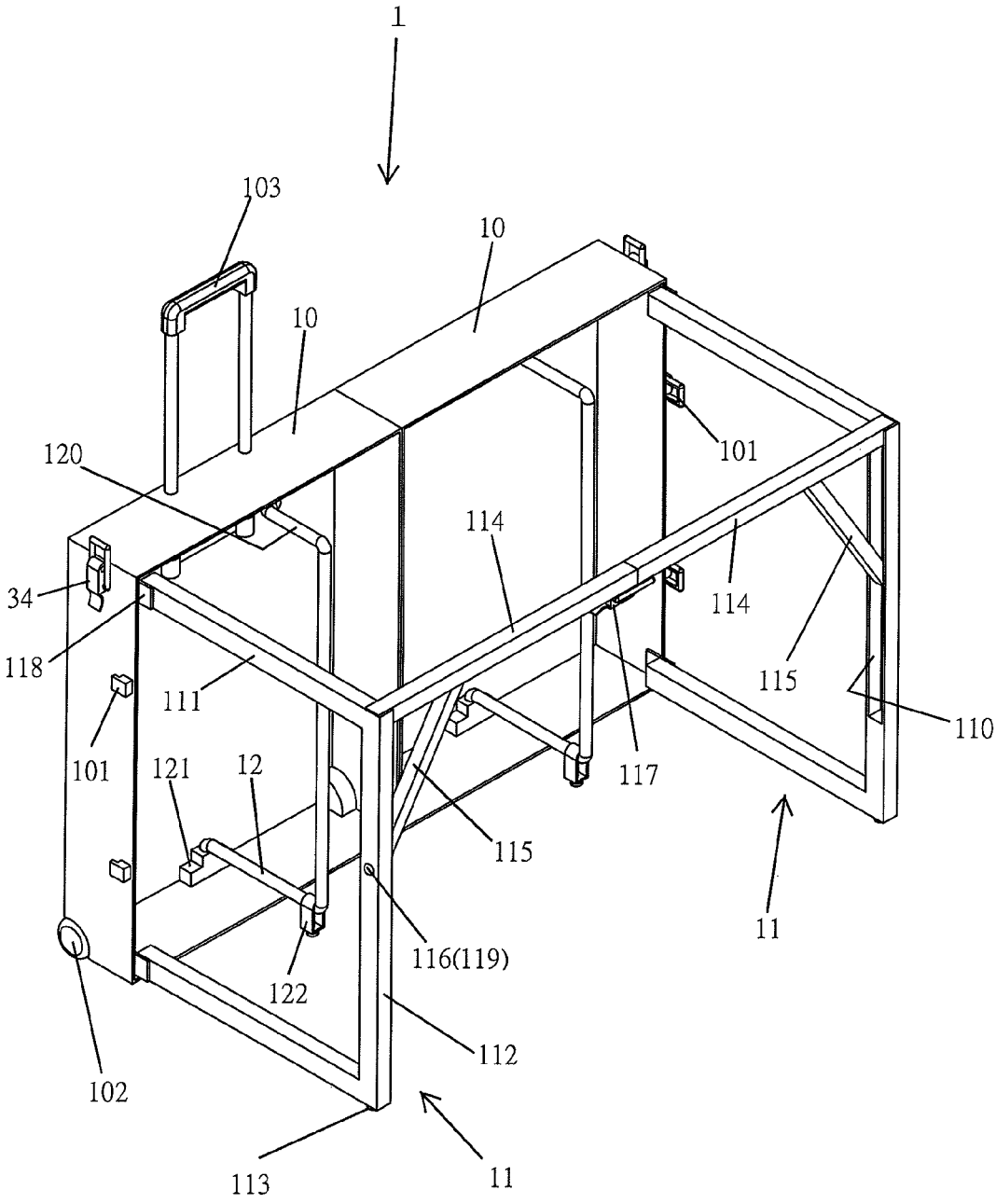
FIG. 2 is a partially perspective view of the foldable table as shown in FIG. 1.
Figure 3:
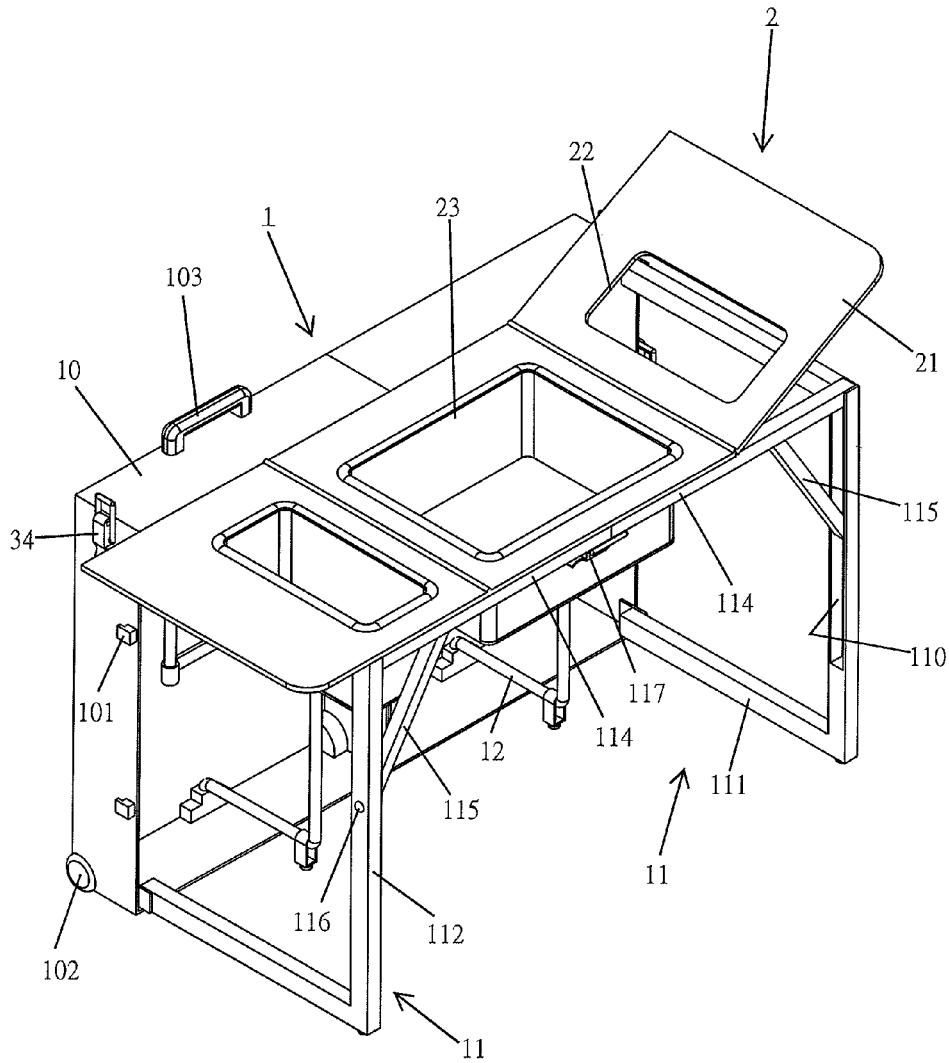
FIG. 3 is a partially perspective view of the foldable table as shown in FIG. 1.
Figure 4:
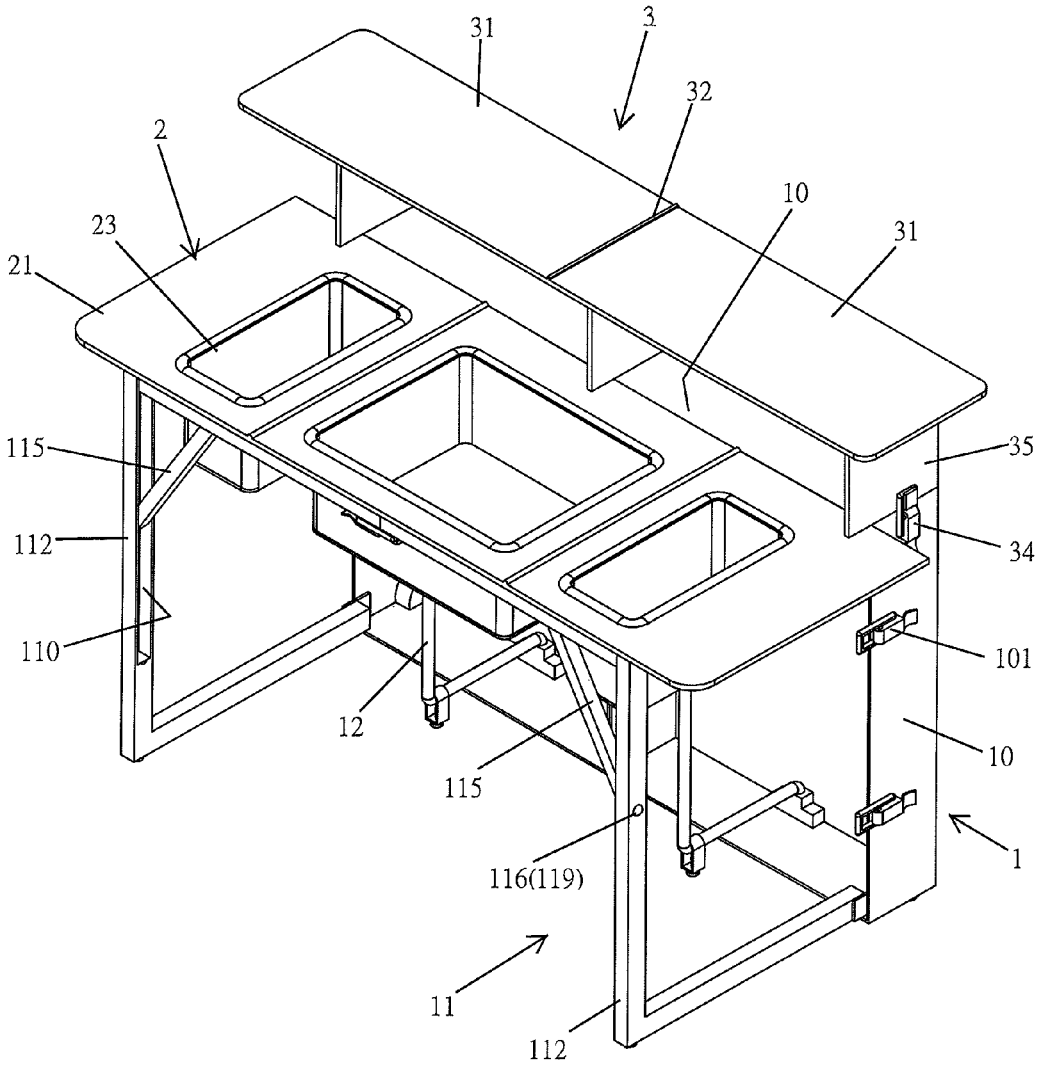
FIG. 4 is a partially perspective view of the foldable table as shown in FIG. 1.
Figure 5:
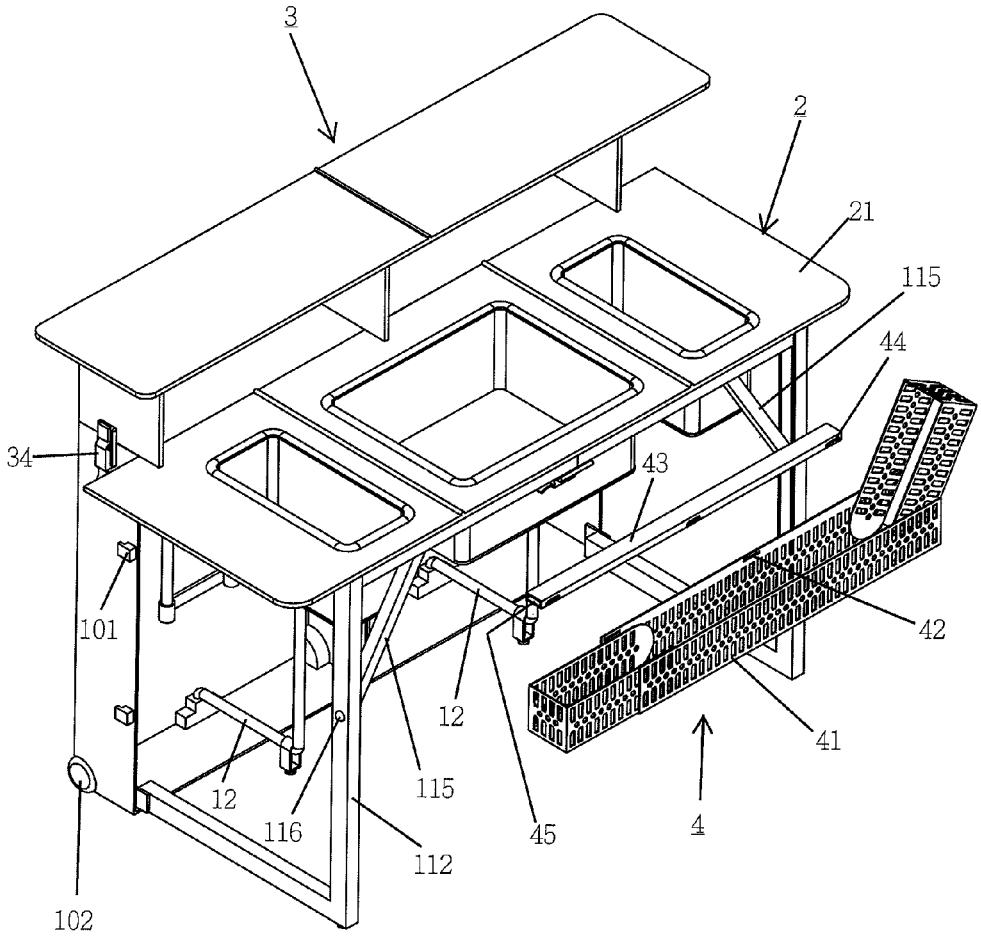
FIG. 5 is a partially exploded perspective view of the foldable table as shown in FIG. 1.
Figure 6:
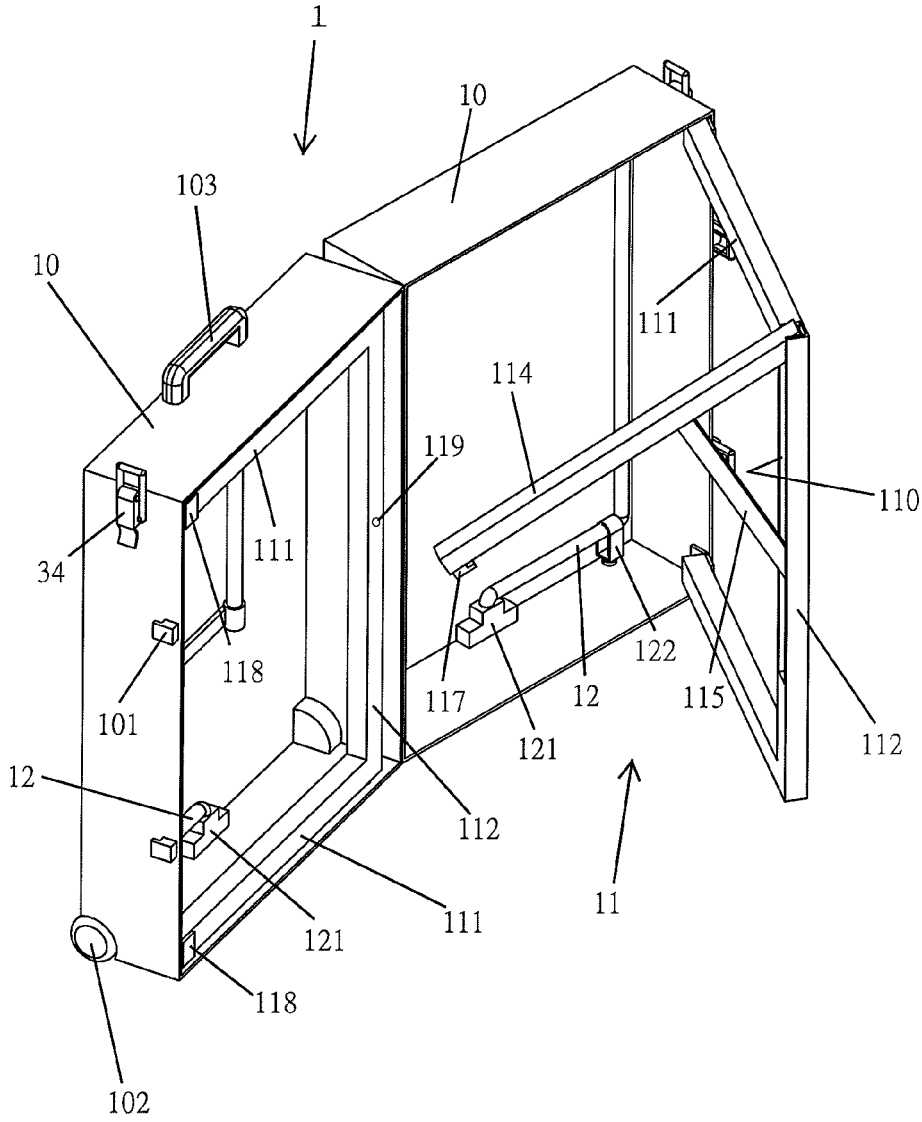
FIG. 6 is a partially folded view of the foldable table as shown in FIG. 2.

In operation, referring to FIG. 6 with reference to FIGS. 1-5, the wine storage rack 4 is removed from the rack 2 and is folded, the platform 3 is removed from the stand 1 and is folded, and the rack 2 is removed from the stand 1 and is folded to expose the stand 1 as shown in FIG. 2. Then, the fastening member 117 is unlocked to disconnect the second ends of the crossbars 114 of the two support frames 11. Then, the locking boss 116 of the oblique strut 115 of each of the two support frames 11 is detached from the locking hole 119 of the upright post 112, so that the oblique strut 115 of each of the two support frames 11 is moved downward in the guide track 110 of the upright post 112, and the crossbar 114 of each of the two support frames 11 is pivoted and moved downward into the guide track 110 of the upright post 112, thereby folding each of the two support frames 11. In such a manner, each of the two reinforcing frames 12 and each of the two support frames 11 can be pivoted into and received in the respective casing 10, and the two casings 10 can be pivoted and closed so as to fold the stand 1.

Accordingly, the foldable table can function as a bar table, desk, counter, sink, water tank, cabinet, shelf, wine compartment and the like, by provision of the rack 2, the placement boxes 23, the platform 3 and the wine storage rack 4, so that the foldable table has multiple functions, thereby greatly enhancing the versatility of the foldable table. In addition, the foldable table can be folded when not in use, thereby facilitating packaging, transportation and storage of the foldable table. Further, the foldable table is expanded and folded easily and quickly, thereby facilitating a user operating the foldable table. Further, the foldable table is folded to have a smaller volume and to have the shape of a luggage, thereby facilitating the user carrying the foldable table.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A table, comprising:

a stand including:

two casings pivotally connected with each other;

two opposite support frames detachably connected with each other and each pivotally mounted on a respective one of the two casings;

wherein each of the two support frames of the stand includes:

two transverse bars each having a first end pivotally mounted on the respective casing;

an upright post mounted between second ends of the two transverse bars to connect the two transverse bars;

a crossbar connected with the upright post;

each of the two support frames of the stand further includes:

an oblique strut mounted between the upright post and the crossbar;

each of the two support frames of the stand is foldable;

the oblique strut of each of the two support frames has a first end mounted on the crossbar and a second end detachably locked onto the upright post;

the upright post of each of the two support frames has a side provided with a locking hole;

the second end of the oblique strut of each of the two support frames is provided with a protruding locking boss detachably locked in the locking hole of the upright post to releasably lock the oblique strut onto the upright post;

the upright post of each of the two support frames has an inner portion provided with an elongate guide track to receive the crossbar and the oblique strut when the crossbar and the oblique strut are folded.

2. The table of claim 1, wherein each of the two support frames of the stand further includes:

a foot pad mounted on a lower end of the upright post.

3. The table of claim 1, wherein the upright post and the two transverse bars of each of the two support frames form a substantially U-shaped profile.

4. A table, comprising:

a stand including:

two casings pivotally connected with each other;

two opposite support frames detachably connected with each other and each pivotally mounted on a respective one of the two casings;

wherein each of the two support frames of the stand includes:

two transverse bars each having a first end pivotally mounted on the respective casing;

an upright post mounted between second ends of the two transverse bars to connect the two transverse bars;

a crossbar connected with the upright post;

the crossbar of each of the two support frames has a first end pivotally mounted on an upper end of the upright post;

second ends of the crossbars of the two support frames are detachably connected with each other by a fastening member.

5. The table of claim 1, wherein the locking boss the oblique strut of each of the two support frames is locked in the locking hole of the upright post when the crossbar is disposed at a horizontal state.

6. The table of claim 1, wherein the stand further includes:

two opposite reinforcing frames each pivotally mounted on a respective one of the two casings.

7. The table of claim 6, wherein each of the two reinforcing frames of the stand has a substantially U-shaped profile.

8. The table of claim 7, wherein each of the two reinforcing frames has an upper end pivotally mounted in the respective casing and a lower end pivotally mounted in the respective casing by a pivot seat.

9. The table of claim 8, wherein the lower end of each of the two reinforcing frames is provided with a support foot spaced from the pivot seat.

10. The table of claim 6, wherein the foldable table further comprises a rack mounted on the stand and supported by the two support frames and the two reinforcing frames of the stand;

the rack is foldable and includes a plurality of flat plates pivotally connected with each other and arranged in a serial manner;

each of the flat plates of the rack has a surface provided with a receiving slot to receive a placement box.

11. The table of claim 10, wherein the foldable table further comprises a wine storage rack detachably mounted on the rack;

the wine storage rack is foldable;

the wine storage rack includes:

a mounting bracket detachably mounted on the flat plates of the rack;

a plurality of receiving baskets detachably mounted on the mounting bracket;

the mounting bracket of the wine storage rack has an inner portion provided with a locking slot detachably locked onto the flat plates of the rack;

the mounting bracket of the wine storage rack has a side provided with a plurality of hanging hooks;

the receiving baskets of the wine storage rack are pivotally connected with each other and arranged in a serial manner;

the receiving baskets of the wine storage rack are provided with a plurality of hanging holes detachably hooked onto the hanging hooks of the mounting bracket.

12. The table of claim 1, wherein each of the two casings of the stand has a side provided with a snap fastener to fasten the two casings when the two casings are folded and juxtaposed to each other.

13. The table of claim 1, wherein the stand further includes:

a handle retractably mounted on one of the two casings.

14. The table of claim 1, wherein the stand further includes:

a castor rotatably mounted on at least one of the two casings.

15. The table of claim 1, wherein the foldable table further comprises a platform mounted on the stand and supported by the two casings of the stand;

the platform is detachably locked onto the two casings of the stand by two snap latches;

the platform is foldable;

the platform includes:

a plurality of elongate boards pivotally connected with each other and arranged in a serial manner;

a plurality of upright legs mounted on the elongate boards;

the elongate boards of the platform are pivotally connected with each other by a plurality of hinges.

* * * * *